US006050442A

United States Patent [19]

Wysocki

[11] Patent Number: 6,050,442

[45] Date of Patent: Apr. 18, 2000

[54] MULTI-COMPARTMENT CONTAINERS, HINGED LID AND DIVIDER ASSEMBLIES THEREFOR, AND HINGE ASSEMBLIES

[75] Inventor: Edward H. Wysocki, Kentwood, Mich.

[73] Assignee: Cascade Engineering, Inc., Grand Rapids, Mich.

[21] Appl. No.: 08/937,179

[22] Filed: Sep. 25, 1997

Related U.S. Application Data

[60] Provisional application No. 60/027,442, Sep. 27, 1996.

[51] Int. Cl.[7] ..... A47G 19/00

[52] U.S. Cl. ..... 220/524; 220/338; 220/909

[58] Field of Search ..... 220/524, 327, 220/328, 908, 338, 909

[56] References Cited

U.S. PATENT DOCUMENTS

| | | | |
|---|---|---|---|
| D. 142,275 | 8/1945 | Kohen | 220/909 X |
| D. 343,490 | 1/1994 | Ramsey . | |
| 760,434 | 5/1904 | Donohue | 220/524 |
| 1,470,199 | 10/1923 | Small | 220/524 X |
| 1,626,842 | 5/1927 | Kendall . | |
| 2,627,995 | 2/1953 | Waterman . | |
| 3,964,609 | 6/1976 | Perrella . | |
| 4,181,236 | 1/1980 | Prodel . | |
| 4,301,942 | 11/1981 | Kupperman et al. | 220/338 X |
| 4,466,541 | 8/1984 | Tabler et al. . | |
| 4,729,475 | 3/1988 | Kurkjian et al. . | |
| 4,967,924 | 11/1990 | Murofushi et al. | 220/338 X |
| 5,035,563 | 7/1991 | Mezey . | |
| 5,054,640 | 10/1991 | Tucker . | |
| 5,085,342 | 2/1992 | Strawder . | |
| 5,109,980 | 5/1992 | Matsuoka et al. . | |
| 5,129,535 | 7/1992 | Hradisky . | |
| 5,129,543 | 7/1992 | White . | |
| 5,171,119 | 12/1992 | Carson . | |
| 5,303,841 | 4/1994 | Mezey . | |
| 5,327,682 | 7/1994 | Holtz . | |
| 5,427,265 | 6/1995 | Cautereels et al. . | |
| 5,445,397 | 8/1995 | Evans | 220/909 X |
| 5,879,015 | 3/1999 | Ramsey et al. . | |

*Primary Examiner*—Steven Pollard
*Attorney, Agent, or Firm*—Rader, Fishman, Grauer & Mc Garry, an Office of Rader, Fishman & Grauer PLLC

[57] ABSTRACT

A multi-compartment container includes a partition member located in the container a pair of lids pivotally attached to the partition member. Each lid includes a pair of integrally molded hinge arms and one or more integrally molded cantilevered hinge pins extends laterally from each of the hinge arms of each lid along a common pivot axis. Spaced sockets are formed in the partition member for pivotally receiving the cantilevered hinge pins of each lid. Some of the hinge pins of each lid have a beveled end surface, and the partition member has a beveled surface adjacent some of the sockets complementary to the hinge pin beveled end surfaces. With this arrangement, each of the lids can be installed on the container by aligning the beveled surfaces of the pins and partition wall, and forcing the hinge pins in a camming action along the beveled surfaces until the hinge pins snap into their respective sockets. Each lid has at least one rib integrally formed with a lower surface thereof and a channel integrally formed with the upper surface thereof. The channel is sized to receive a rib of an adjacent lid when a plurality of lids are stacked together.

29 Claims, 4 Drawing Sheets

MULTI-COMPARTMENT CONTAINERS, HINGED LID AND DIVIDER ASSEMBLIES THEREFOR, AND HINGE ASSEMBLIES

RELATED APPLICATION

This application claims the benefit of U.S. Provisional Application No. 60/027,442 filed on Sep. 27, 1996.

BACKGROUND OF THE INVENTION

1. Field of the Invention

This invention relates to multi-compartment containers. In one of its aspects, the invention relates to a hinge assembly for lids of multi-compartment containers. In another of its aspects, the invention relates to a lid and divider assembly for a multi-compartment container.

2. Description of the Related Art

Waste materials or refuse which comprises a number of recyclable components such as aluminum cans, glass, paper, etc., have conventionally been collected as a conglomerate and disposed of in a landfill. It has been the practice of some individuals, communities and waste management companies to separate the recyclable components from the nonrecyclables and place them in separate containers depending on their composition. However, emptying the separate containers into separate bins or compartments in a refuse truck or other collection device is time consuming and labor intensive. Such systems also require a substantial investment in containers which can impose a prohibitive capital investment on a refuse collection agency or home owner. The separate containers occupy more space than desired and each must be manually transported to a collection location, such as a curb or alley way on a regular basis for pick-up.

In an attempt to overcome these problems, several containers having two or more compartments with a separate lid for each compartment have been developed. In one container, a pair of lids are attached to a central partition member through a common central hinge arrangement and are pivotal toward each other for access to the compartments. In these hinge arrangements, each of the lids have molded projections which fit with each other and projections on the divider to form an aligned row of such projections. Each of the projections has an axial opening which receives a steel or plastic pivot rod to rotatably mount the lids to the central hinge. A screw is used to mechanically fasten the pivot rod to the divider and thus fasten the lids to the divider. One disadvantage associated with this type of arrangement is that it is time consuming to assemble the lids to the divider with the rod and screw. Another disadvantage is that the screw may become loose and cause possible separation of the rod from the divider and thereby separate the lids from the container. This type of damage is not easily repairable, if at all. Covers that function properly are required in many communities for sanitary reasons. Consequently, when one or more covers separate from their container, the home owner or collection agency is left no other option but to purchase a new container.

SUMMARY OF THE INVENTION

These and other problems of the prior art are overcome by the provision of a divided container having an integrally molded hinge assembly for rotatably attaching a pair of lids thereto. Preferably, a partition member is located in the container and divides the container into separate chambers. The lids are associated with different chambers and are hinged to the partition member such that the lids pivot toward each other upon opening.

According to one embodiment of the invention, a pair of spaced hinge arms extend from either the partition member or each of the lids. At least one cantilevered hinge pin extends laterally from each of the hinge arms along a pivot axis, and spaced sockets are formed in the other of the partition member and lids for pivotally receiving the cantilevered hinge pins. In a preferred arrangement, the hinge arms extend from the lids and the spaced sockets are formed in the partition member. A pair of cantilevered hinge pins preferably extend from opposite sides of one of the hinge arms of each lid and the one hinge arm is located at a central portion of the inner side. The other hinge arm is located adjacent one of the lateral sides of each lid.

In the preferred arrangement, the partition member comprises a partition wall having an upper edge connected to a lower edge by a pair of side edges; a first hinge joint extending upwardly from the upper edge adjacent one of the side edges; a second hinge joint extending upwardly from the upper edge adjacent the other of the side edges; a third hinge joint extending upwardly from the upper edge between the first and second hinge joints; and an opposed pair of sockets formed in each of the first, second and third hinge joints for receiving the cantilevered pins of the lids. With this arrangement, the other hinge arm of each lid is located adjacent one of the first and second hinge joints, the one hinge arm of one of the lids is located between the first and third hinge joints, and the one hinge arm of the other lid is located between the second and third hinge joints, with each of the hinge pins being received in a corresponding one of the sockets when the lids are attached to the partition member. Preferably, the hinge arms and hinge pins are integrally molded with each lid and the hinge joints and sockets are integrally molded with the partition wall.

The opposed hinge pins of each lid have a beveled lower surface and the corresponding hinge joints have a complementary beveled upper surface that faces its corresponding hinge pin beveled surface during installation of the lids on the container. With this arrangement, each of the lids can be installed on the container by aligning the upper and lower beveled surfaces, and forcing the hinge pins in a camming action along the beveled surfaces until the hinge pins snap into their respective sockets.

A flexible membrane can be attached to the upper surface of each lid to cover and protect the hinge arms and partition member against the elements.

According to a further embodiment of the invention, a lid for pivotal attachment to a container comprises an upper surface connected to a lower surface by a pair of side portions and front and rear portions, with the side portions and the front and rear portions defining an outer periphery of the lid; at least one rib integrally formed with one of the upper and lower surfaces and so extending along the outer periphery of the lid; and a channel integrally formed with the other of the upper and lower surfaces and extending along the lid outer periphery. Preferably, the channel is sized to receive a rib of an adjacent lid when a plurality of lids are stacked together.

An elongate rib can also be integrally formed with the upper surface. Preferably, the elongate rib extends between the side portions and adjacent the rear portion to prevent foreign matter from entering the container when the lids are opened.

According to an even further embodiment, an improved divided container having a pair of lids pivotally connected to a central divider comprises at least one hinge arm extending from either the partition member or each lid; a pair of opposed cantilevered hinge pins extending laterally from the at least one hinge arm along a pivot axis; and spaced sockets formed in the other of the partition member and lids for pivotally receiving the cantilevered hinge pins in a snap-fit engagement.

Preferably, the lids are constructed with a flat lower surface which acts as a shelf when one lid is rotated to an overlying position on another lid.

These and other objects, features and advantages will be apparent from the ensuing description taken in conjunction with the accompanying drawings.

BRIEF DESCRIPTION OF THE DRAWINGS

The invention will now be described with reference to the drawings in which.

DETAILED DESCRIPTION OF THE PREFERRED EMBODIMENTS

Figure 1:
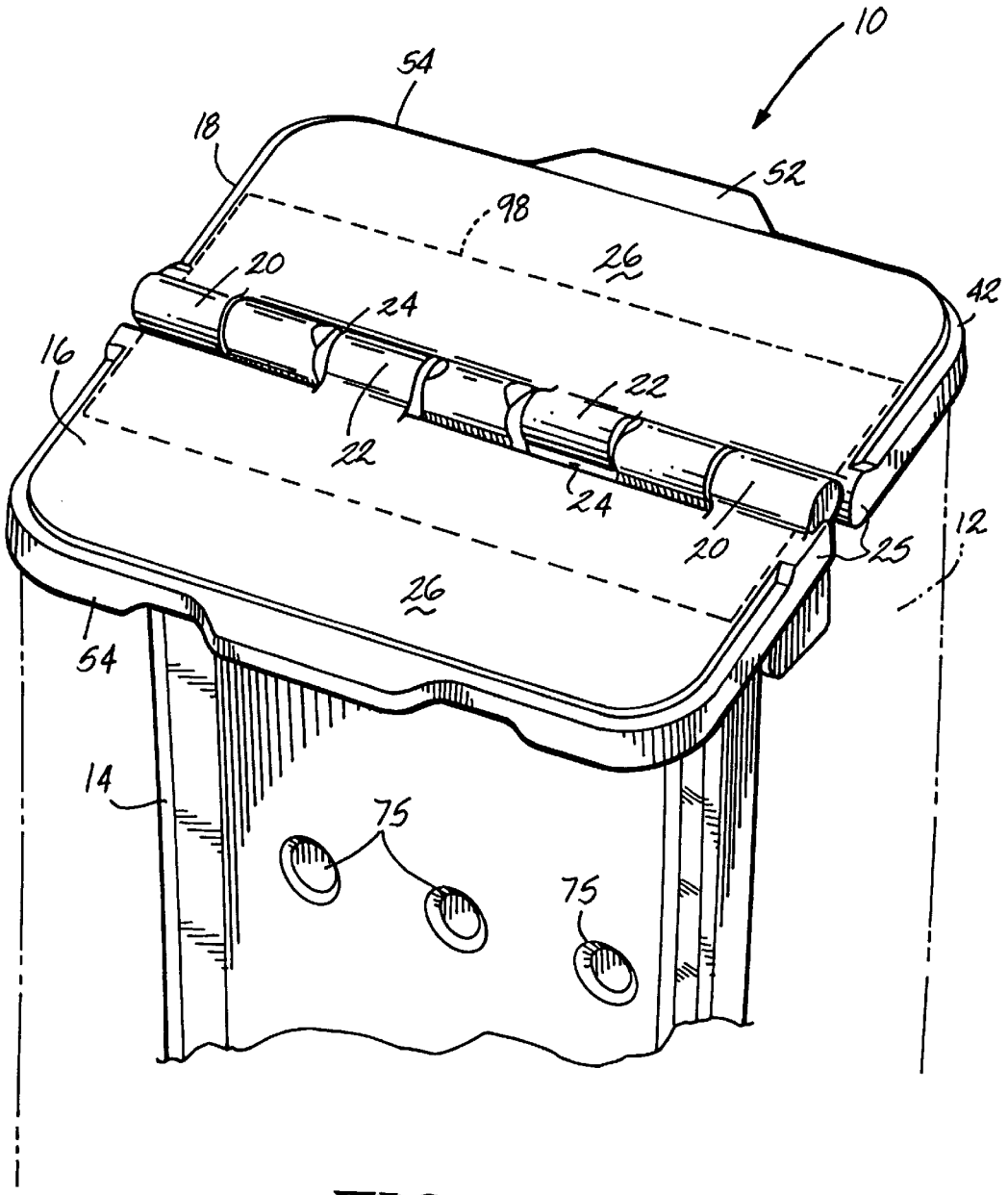
FIG. 1 is a perspective view of a partition member and lid assembly for a divided container according to the invention.

Referring now to FIG. 1, a container assembly 10 includes a container shell 12 (shown in phantom line), a partition member 14, and a pair of lids 16, 18. The partition member 14 is mounted in the container shell 12 through ribs (not shown) in the container in a well known manner to form a container having separate compartments. Alternatively, the partition member 14 can be integrally molded with the container to form a unitary structure.

Figure 2:
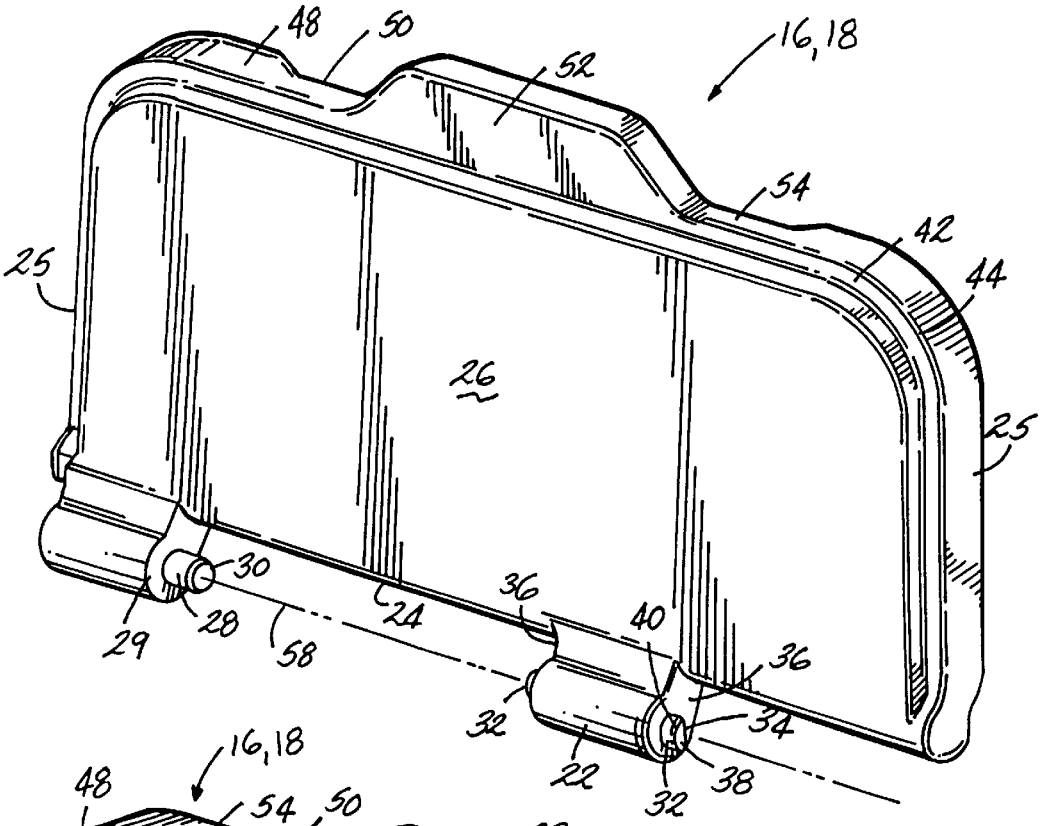
FIG. 2 is a top perspective view of a container lid according to the invention.
Figure 3:
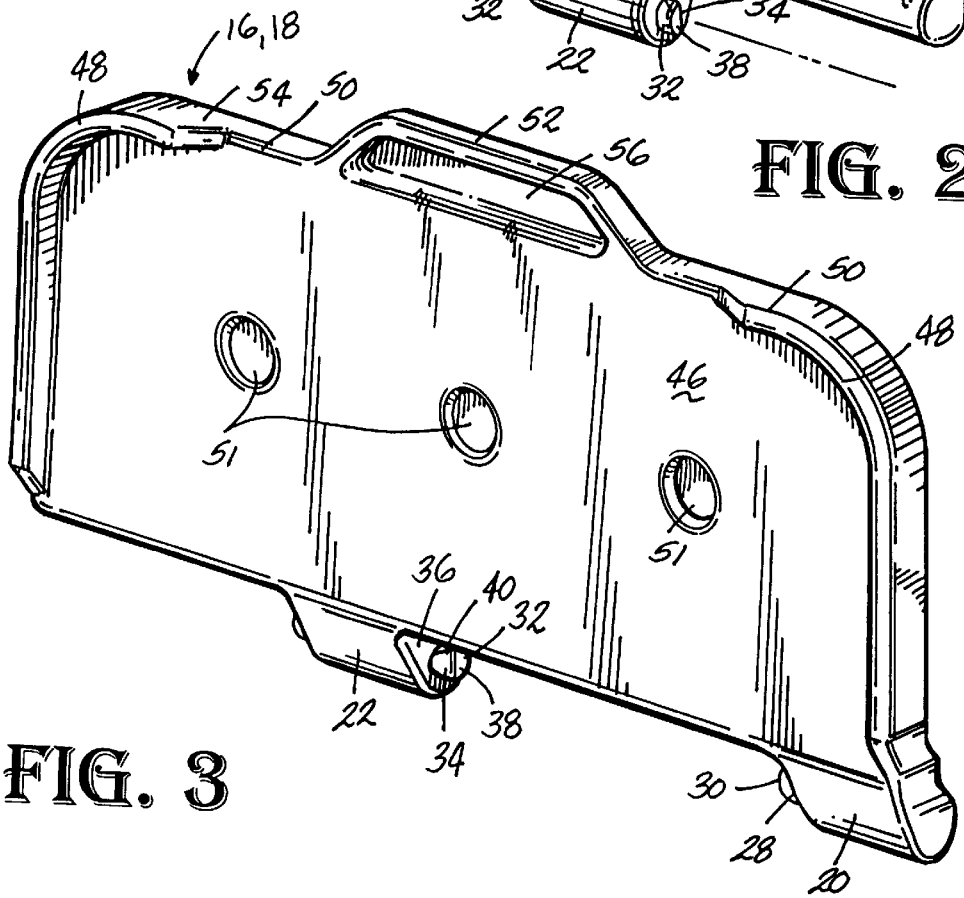
FIG. 3 is a bottom perspective view of the container lid.

With reference now to FIGS. 2 and 3, the lids 16, 18 are identical in shape and each includes an upper surface 26 and a spaced lower surface 46 connected together by an inner side 24, an outer side 54, and a pair of lateral sides 25 interconnecting the inner and outer sides. A first outer hinge arm 20 and a second intermediate hinge arm 22 are integrally molded with each lid and extend outwardly from the inner side 24 and upwardly from the upper surface 26. A cylindrical hinge pin 28 is integrally molded with the outer hinge arm 20 and extends from a hinge arm face 29 parallel with the inner side 24 toward the intermediate hinge arm 22. A chamfer 30 extends around the outer edge of the pin 28. The intermediate hinge arm 22 includes a pair of integrally molded partial hinge pins 32 that extend parallel with the inner side 24 from opposite faces 36 thereof. Each pin 32 is in the form of a cylindrical wedge and includes a beveled flat surface 34 that extends at an acute angle with respect to the face 36 and intersects with the outer pin surface 38, for a purpose to be explained in greater detail below. As with the pin 28, a chamfer 40 extends around the outer edge of each pin 32. The hinge pins 28 and 32 are aligned along a central hinge pin axis 58.

The upper surface 26 of each lid 16, 18 includes a channel 42 that extends along an upper peripheral edge 44 thereof. The lower lid surface 46 includes a pair of ribs 48 that extends along a lower peripheral edge 50. The ribs 48 are sized to fit into the channel 42 to stack the lids 16, 18 for shipping prior to installation on the container. The ribs 48 also serve as drip edges that hang over an upper edge of the container to prevent water or other liquids from entering the container. Recesses 51 are formed in the lower surface 46 of each lid to provide extra stiffening.

A handle 52 extends from the outer side 54 of each lid between the upper and lower peripheral edges 44, 50. The handle 52 is continuous with the upper and lower surfaces 26, 46 of each lid. A handle depression 56 in the lower surface 46 is shaped to receive the fingers of a user to facilitate lid opening.

Figure 4:
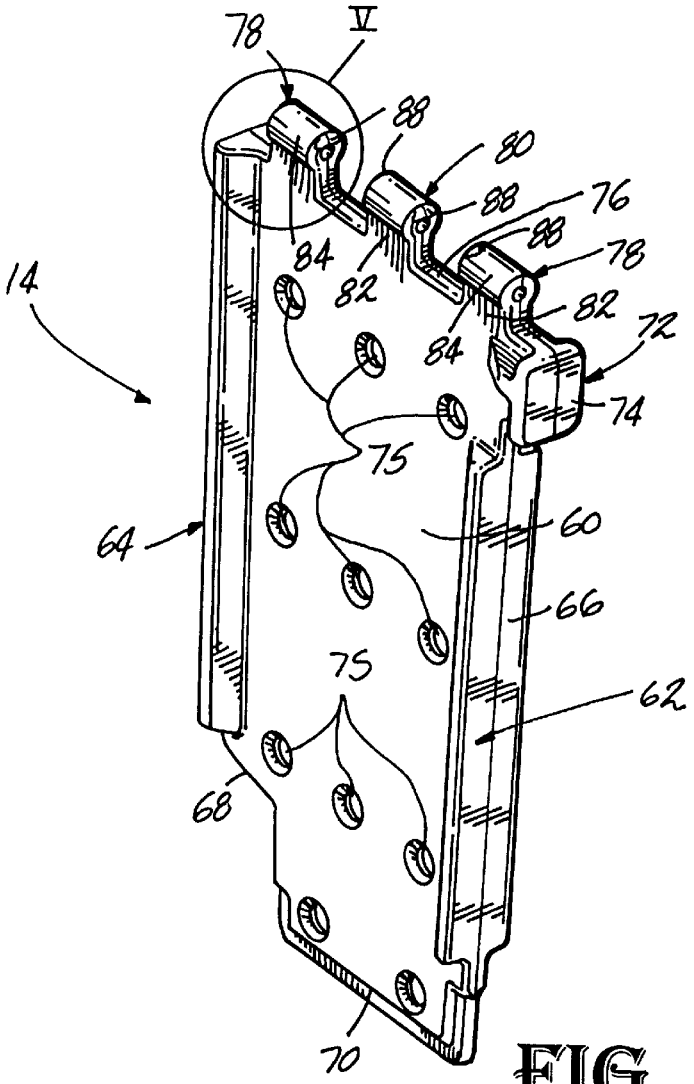
FIG. 4 is a perspective view of the container partition member according to the invention.
Figure 5:
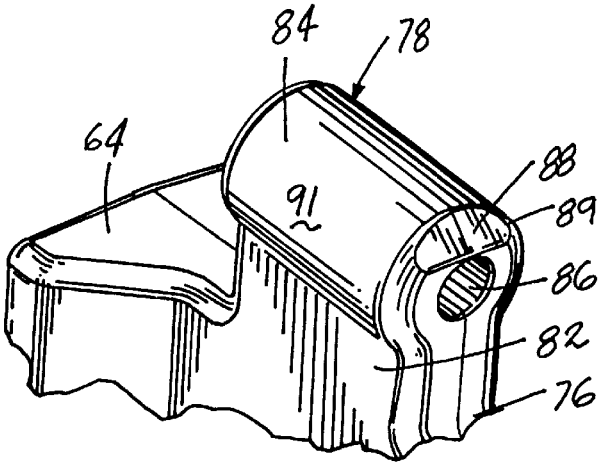
FIG. 5 is an enlarged perspective view of a hinge component extending from the circled area A at an upper end of the container partition member in FIG. 4.

Turning now to FIGS. 4 and 5, the partition member 14 includes a wall 60 having a pair of oppositely disposed flanges 62 and 64. A flat outer surface 66 of each flange is adapted to contact opposing inner walls of the container shell 12 to divide the shell into two compartments. A lower indented portion 68 and a bottom portion 70 are attached to inner surfaces of the container wheel well (not shown) and container bottom (not shown), respectively. An upper side flange 72 includes a flat outer surface 74 that is mounted to, or integral with an expanded inner wall of the container shell 12. As with the lids 16 and 18, a plurality of recesses 75 are formed in the wall 60 to add structural stability to the partition member.

A pair of outer hinge joints 78 and an intermediate hinge joint 80 project upwardly from an upper surface 76 of the partition member 14. The hinge joints are integrally molded with the wall 60. Each hinge joint features a spacer 82 that is positioned adjacent to one of the flanges 62, 64 and extends upwardly from the surface 76. A cylindrical socket 84 is attached to each spacer and includes an opening 86 for receiving one of the hinge pins 28. A beveled surface 88 extends between the opening 86 and the outer surface 91 of the socket and is adapted to register with the beveled surface 34 of one of the outer hinge pins 32. A chamfer 89 extends around the periphery of each beveled surface. The intermediate hinge joint 80 has opposing beveled surfaces 88 while each end hinge joint 78 has a single beveled surface that faces one of the beveled surfaces of the intermediate joint 80.

Each lid 16, 18 is assembled to the partition member 14 by first placing the pin 28 into an opening 86 of one of the end hinge joints 78 on the partition member 14 and rotating the lid about its hinge axis until the beveled surfaces 34 on the partial pins 32 are aligned with the beveled surfaces 88 on the sockets. A sharp blow is then applied to the partial pins to force the pins in a camming action along the beveled surfaces until the partial pins drop into their respective socket openings.

The partition member and lids are preferably constructed of a resilient thermoplastic, for example, polyethylene or polypropylene, by blow molding, so that the beveled surfaces of the partial pin and/or the socket resiliently flex as the lids are installed. The partition member and lids can alternatively be formed by rotational molding or any other well known molding technique.

Although a pair of hinge arms on the lids and corresponding sockets on the partition wall are shown, it is to be understood that a greater number of hinge arms and corresponding sockets can be provided for increased hinge strength and stability. Moreover, although the hinge pins are associated with the lid and the sockets are associated with the partition member, it is to be understood that the hinge pins can be alternatively formed with the partition member and the sockets can be integrally formed with the lids.

Figure 6:
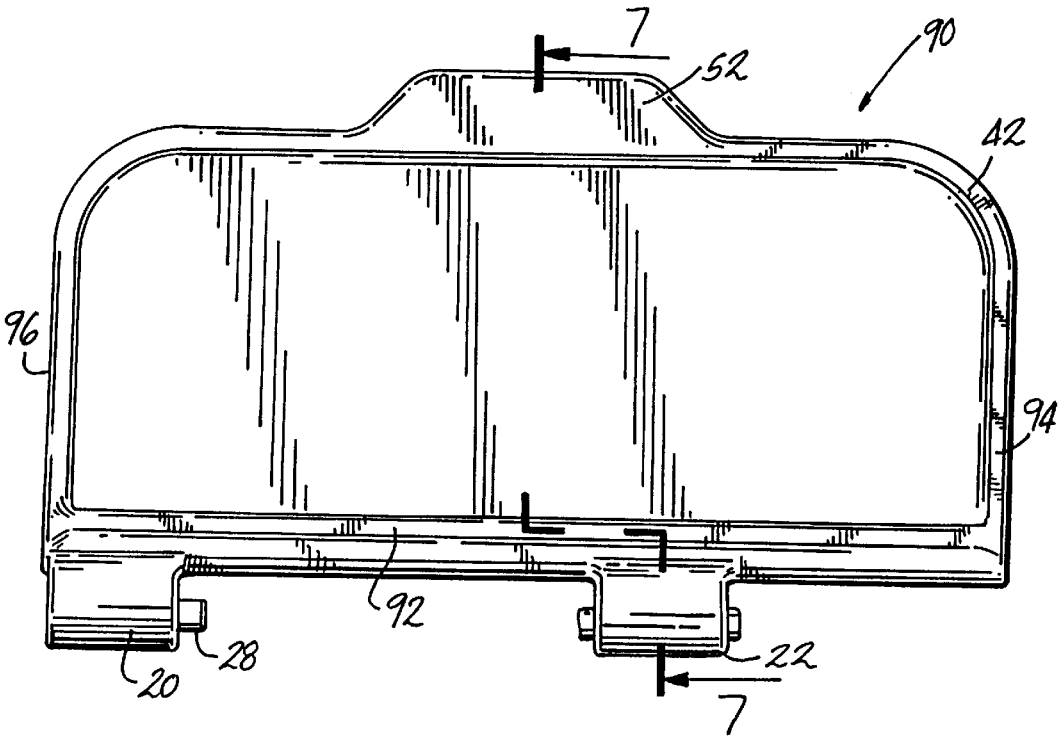
FIG. 6 is a top plan view of a modified container lid according to a second embodiment of the invention.
Figure 7:
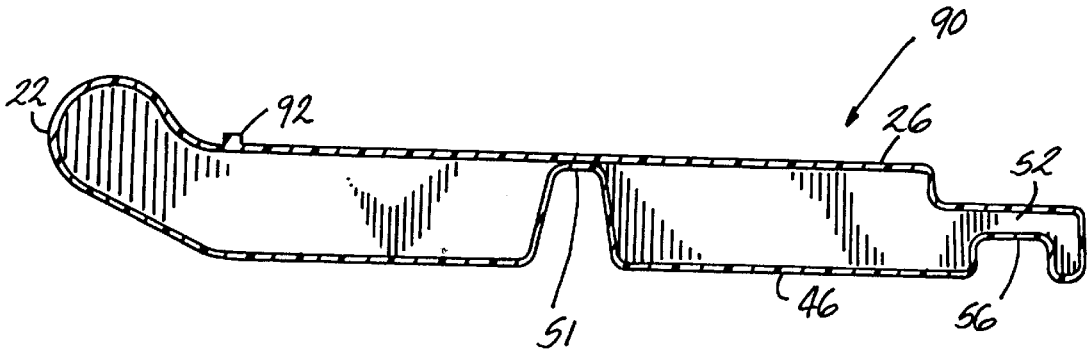
FIG. 7 is a cross section of the modified container lid taken along line 7–7 of FIG. 6.

With reference now to FIGS. 6 and 7, a modified lid 90 is shown, wherein like parts in the previous embodiment are represented by like numerals. A rib 92 is formed in the upper surface 26 and extends from a first end 94 to a second end 96 of the lid 90. The rib 92 extends upwardly from the upper surface 26 and directs any water that may be present on the upper surface away from the hinge assembly when the lid is opened.

Referring again to FIG. 1, a flexible membrane 98 (shown in dashed line) is secured to both lids 16 and 18 through Christmas tree-type fasteners (not shown) or suitable water insoluble adhesives and covers the hinge assembly to prevent water and other liquids from leaking into the interior of the container 12 through the hinge.

The bottom surface 46 of the lids 16 and 18 are relatively flat and form a shelf for temporary storage of materials when one lid is rotated to an overlying position on the lid.

The invention provides a secure hinge and lid assembly with a divider wall in a refuse container. The hinge assembly is easily and quickly assembled with no additional hinge parts (such as a hinge pin and screw) and is not subject to lost parts. Once assembled, the hinge is virtually indestructible under ordinary conditions for the lifetime of the lids. Whereas the invention has been described with reference to hinge assemblies for divided refuse carts, the invention can also be used for other divided containers and for undivided containers.

Reasonable variation and modification are possible within the spirit of the foregoing specification and drawings without departing from the scope of the invention.

The embodiments for which an exclusive property or privilege is claimed are defined as follows:

1. In a divided container having a bottom wall attached to an upstanding wall defining a container interior and an open top, a partition member located in the container interior for dividing the container into separate chambers and a pair of lids pivotally connected to the partition member for pivotal movement about a pivot axis and covering the open top of the chambers, the improvement comprising:

a pair of spaced hinge arms integral with and extending from one of the partition member and the lids;

at least one cantilevered hinge pin integral with and extending laterally from each of the hinge arms along the pivot axis; and spaced sockets formed along the pivot axis in the other of the partition member and lids for pivotally receiving the cantilevered hinge pins.

2. A divided container according to claim 1 wherein the pair of spaced hinge arms extend from each lid and the sockets are formed in the partition member.

3. A divided container according to claim 2 wherein a pair of cantilevered hinge pins extend from opposite sides of one of the hinge arms.

4. A divided container according to claim 3 wherein the one hinge arm is located at a central portion of the inner side of each lid.

5. A divided container according to claim 4 wherein each lid includes a pair of lateral sides extending from the inner side, the other hinge arm extending from the inner side adjacent one of the lateral sides.

6. A divided container according to claim 5 wherein the partition member comprises:

a partition wall having an upper edge connected to a lower edge by a pair of side edges;

a first hinge joint extending upwardly from the upper edge adjacent one of the side edges;

a second hinge joint extending upwardly from the upper edge adjacent the other of the side edges;

a third hinge joint extending upwardly from the upper edge between the first and second hinge joints; and an opposed pair of said sockets formed in each of the first, second and third hinge joints for receiving the cantilevered pins of the lids, such that the other hinge arm of each lid is located adjacent one of the first and second hinge joints, the one hinge arm of one of the lids is located between the first and third hinge joints, and the one hinge arm of the other lid is located between the second and third hinge joints, with each of the hinge pins being received in a corresponding one of the sockets when the lids are attached to the partition member.

7. A divided container according to claim 6 wherein the hinge arms and hinge pins are integrally molded with each lid.

8. A divided container according to claim 7 wherein the hinge joints and sockets are integrally molded with the partition wall.

9. A divided container according to claim 6 wherein the opposed hinge pins of each lid each have a beveled lower surface and the corresponding hinge joints each have a beveled upper surface that faces its corresponding hinge pin beveled surface during installation of the lids on the container;

whereby each of the lids can be installed on the container by placing the hinge pin of the other hinge arm into one of the opposed sockets of one of the first and second hinge joints, aligning the upper and lower beveled surfaces, and forcing the hinge pins in a camming action along the beveled surfaces until the hinge pins snap into their respective sockets.

10. A divided container according to claim 9 wherein the hinge arms and hinge pins are integrally molded with each lid.

11. A divided container according to claim 10 wherein the hinge joints and sockets are integrally molded with the partition wall.

12. A divided container according to claim 1 wherein the hinge arms and hinge pins are integrally molded with the one of the partition member and the lids.

13. A divided container according to claim 12 wherein the sockets are integrally molded with the other of the partition member and the lids.

14. A divided container according to claim 1 wherein each lid has an upper surface and a lower surface, and further comprising:

at least one rib integrally formed with one of the surfaces and extending along an outer peripheral portion of the lid; and a channel integrally formed with the other of the surfaces and extending along the outer peripheral portion of the lid, the channel being sized to receive a rib of an adjacent lid when the lids are stacked together.

15. A divided container according to claim 14 wherein the at least one rib is integrally formed with the lower surface of each lid such that each rib hangs over an upper edge of the container when its associated lid is in a closed position to thereby prevent liquid from entering into the container.

16. A divided container according to claim 15 wherein the outer peripheral portion of each lid comprises a rear portion connected to a front portion by a pair of lateral side portions;

and further comprising an elongate rib integrally formed with the upper surface of each lid, the elongate rib extending between the lateral side portions of each lid and adjacent the rear portion to prevent foreign matter from entering the container when the lids are opened.

17. A divided container according to claim 15 and further comprising a flexible membrane attached to the upper surface of each lid, the flexible membrane covering the hinge arms and partition member.

18. A divided container according to claim 1 wherein each lid comprises an upper surface, a lower surface, and a peripheral portion defined by a rear portion connected to a front portion by a pair of lateral side portions, the peripheral portion extending between the upper and lower surfaces; and further comprising an elongate rib integrally formed with the upper surface of each lid, the elongate rib extending between the side portions and adjacent the rear portion to prevent foreign matter from entering the container when the lids are opened.

19. A divided container according to claim 1 and further comprising a flexible membrane attached to an upper surface of each lid, the flexible membrane covering the hinge arms and partition member.

20. A divided container according to claim 1 wherein the hinge arms and cantilevered hinge pins are integrally molded with the one of the partition member and the lids, with at least some of the hinge pins having a beveled end surface; and further wherein the other of the partition member and the lids has a beveled surface adjacent at least some of the sockets complementary to the hinge pin beveled end surfaces, such that the at least some hinge pins can be snap-fit into the at least some sockets.

21. A lid for pivotal attachment to a container, comprising:

an upper surface connected to a lower surface by a pair of side portions and front rear portions, the side portions and the front and rear portions defining an outer periphery of the lid;

at least one rib integrally formed with one of the upper and lower surfaces and extending along the outer periphery of the lid; and a channel integrally formed with the other of the upper and lower surfaces and extending along the lid outer periphery, the channel being sized to receive a rib of an adjacent lid when a plurality of lids are stacked together.

22. A lid according to claim 21 and further comprising an elongate rib integrally formed with the upper surface, the elongate rib extending between the side portions and adjacent the rear portion to prevent foreign matter from entering the container when the lids are opened.

23. A lid according to claim 22 and further comprising a pair of spaced hinge arms extending from the rear portion; and a cantilevered hinge pin extending laterally from each of the hinge arms of each lid along a pivot axis.

24. A lid according to claim 23 wherein the hinge arms and hinge pins are integrally molded with each lid.

25. A lid according to claim 21 and further comprising a pair of spaced hinge arms extending from the rear portion; and a cantilevered hinge pin extending laterally from each of the hinge arms of each lid along a pivot axis.

26. A lid according to claim 25 wherein the hinge arms and hinge pins are integrally molded with each lid.

27. A lid according to claim 26 and further comprising a handle integrally molded with the front portion.

28. In a divided container having a bottom wall attached to an upstanding wall defining a container interior and an open top, a partition member located in the container interior for dividing the container into separate chambers and a pair of lids pivotally connected to the partition member for pivotal movement about a pivot axis and covering the open top of the chambers, the improvement comprising:

at least one integral hinge arm extending from one of the partition member and the lids;

a pair of opposed cantilevered hinge pins integral with and extending laterally from the at least one hinge arm along the pivot axis; and spaced sockets formed along the pivot axis in the other of the partition member and the lids for pivotally receiving the cantilevered hinge pins.

29. A divided container according to claim 28 wherein the at least one hinge arm and cantilevered hinge pins are integrally molded with the one of the partition member and the lids, with at least one of the hinge pins having a beveled end surface; and further wherein the other of the partition member and the lids has a beveled surface adjacent at least one of the sockets complementary to the at least one hinge pin beveled end surface, such that the at least one hinge pin can be snap-fit into the at least one socket.

* * * * *